US007631449B2

(12) United States Patent
McDermott et al.

(10) Patent No.: US 7,631,449 B2
(45) Date of Patent: Dec. 15, 2009

(54) WRISTBAND AND CLASP THEREFOR

(75) Inventors: Robert McDermott, Sandy, UT (US); Adam Preisach, Saugus, CA (US); Andrew Bishop, Mission Viejo, CA (US)

(73) Assignee: The St. John Companies, Inc., Valencia, CA (US)

( * ) Notice: Subject to any disclaimer, the term of this patent is extended or adjusted under 35 U.S.C. 154(b) by 8 days.

(21) Appl. No.: 11/558,401

(22) Filed: Nov. 9, 2006

(65) Prior Publication Data

US 2008/0110069 A1 May 15, 2008

(51) Int. Cl.

| | |
|---|---|
| ***A44C 5/00*** | (2006.01) |
| ***G09F 3/02*** | (2006.01) |
| ***G09F 3/14*** | (2006.01) |
| ***A44B 11/12*** | (2006.01) |
| ***A44B 11/00*** | (2006.01) |

(52) U.S. Cl. ..... 40/633; 40/625; 40/665; 24/170; 24/173; 24/134 KB

(58) Field of Classification Search ..... 40/633, 40/665, 625; 24/170, 173, 134 KB
See application file for complete search history.

(56) References Cited

U.S. PATENT DOCUMENTS

| | | | | |
|---|---|---|---|---|
| 4,783,917 | A * | 11/1988 | Smith et al. | 40/633 |
| 5,226,809 | A | 7/1993 | Franco | |
| 5,448,846 | A | 9/1995 | Peterson et al. | |
| 5,479,797 | A | 1/1996 | Peterson | |
| 5,577,395 | A * | 11/1996 | Kuykendall | 63/3 |
| 5,758,443 | A * | 6/1998 | Pedrazzini | 40/633 |
| 5,979,095 | A | 11/1999 | Schneider et al. | |
| 7,137,216 | B2 * | 11/2006 | Ali et al. | 40/633 |
| 7,197,842 | B2 | 4/2007 | Ali | |
| 2008/0028654 | A1 | 2/2008 | Cardon et al. | |

OTHER PUBLICATIONS

Sato DCS & Labeling Worldwide, Product Information DuraMark Wristbands, Sato HealthCARE ID Solutions, 2 pp.
Sato DCS & Labeling Worldwide, Company Information: "The countdown to HIPAA Compliancy . . . ", Sato HealthCARE ID Solutions, 32 pp.
The St. John Companies, Inc.; "Patient Identification Wristbands"; Patient ID Expert.com; http://www.patientidexpert.com/alert_standardization.html; 11pp.

* cited by examiner

*Primary Examiner*—Lesley D Morris
*Assistant Examiner*—Syed A Islam
(74) *Attorney, Agent, or Firm*—Christie, Parker & Hale, LLP

(57) ABSTRACT

A wristband and clasp for securing the wristband to a person is disclosed. The wristband includes at least one attachment aperture. The clasp includes a folding base having a first triangular section connected to a second triangular section and a hinge connecting the first and second triangular sections. The hinge defines a folding axis that enables the base to be folded so that the first triangular section is positioned adjacent to the second triangular section in an overlapping relationship. A securement aperture is formed in the first triangular section, and a post extends from the second triangular section to couple with the securement aperture when the base is folded along the folding axis. The post extends from the second triangular section through the attachment aperture of the wristband and couples to the securement aperture of the first triangular section so that the clasp is secured to the wristband.

20 Claims, 5 Drawing Sheets

WRISTBAND AND CLASP THEREFOR

BACKGROUND

1. Field

The field of the present invention relates to an identification assembly, and in particular, to a clasp device for securing an identification wristband to a person, and to an assembly of a wristband and clasp assembly.

2. Related Art

Wristbands are used in hospitals to identify patients and for similar purposes in other instructional/institutional settings. In general, a wristband is attached to a patient's wrist or other appendage, such as a patient's ankle, with a fastener. Conventional wristbands have two ends and a plurality of holes along the length of the wristband. Typical fasteners are rectangular with a large footprint and have one or two stems or posts that extend through at least two holes of each end of the wristband to attach the two ends of the wristband together. Some conventional fasteners use one stem through two holes of each end of the wristband to attach the wristband to a patient's wrist. However, the single stem often results in twisting of the wristband on the patient's skin, which can often be uncomfortable. Other conventional fasteners use two stems through two holes of each end of the wristband to inhibit twisting or rotation of one end the wristband relative to the other end while the wristband is attached to a patient's wrist. However, two stems often require a larger sized clasp, which can be cumbersome.

SUMMARY

An identification assembly for a person includes a clasp device for securing an identification wristband to a person is disclosed.

In one embodiment, an identification assembly for a person includes a wristband having a display portion and a first fastening portion extending from one end of the display portion and a second fastening portion extending from the other end of the display portion. The first fastening portion includes at least one attachment aperture, and the second fastening portion includes a plurality of attachment apertures arranged along its center line. The assembly includes at least one clasp having a folding base with first and second triangular sections connected together via a hinge that enables the base to be folded along a folding axis from an open position to a closed position so that the first and second triangular sections are adjacently positioned. The at least one clasp includes a securement aperture formed in the first triangular section and a post extending from the second triangular section that couples to the securement aperture when the base is folded along the folding axis in the closed position. The post extends from the second triangular section through the at least one attachment aperture of the first fastening portion and at least one attachment aperture of the second fastening portion of the wristband and couples to the securement aperture of the first triangular section so that the clasp is fastened to the wristband and the first and second fastening portions are attached together.

In one aspect, the at least one clasp is securable to any one of the attachment apertures of the first and second fastening portions. The display portion comprises a flat, rectangular section that is adapted to receive a label or direct print or written information. The fastening portions overlap in a manner such that the attachment apertures of the fastening portions are aligned whereby the post extends through the attachment apertures for securing the fastening portions together. A plurality of clasps are fastened to the wristband, and each clasp is positioned adjacent and proximate to each other in an alternating or interleaving relationship. A plurality of clasps are fastened to the plurality of attachment apertures of the second fastening portion in an alternating or interleaving relationship such that at least one clasp is fastened to at least one attachment aperture from a first edge of the wristband and at least one other clasp is fastened to at least one other attachment aperture from a second edge of the wristband that is opposite of the first edge. Each fastening portion of the wristband has a width that is smaller than the width of the display portion. The fastening portions of the wristband extend from a central region of the display portion so that the width of the fastening portions are centered within the width of the display portion.

In one aspect, the hinge of the clasp is formed integrally with the first and second triangular sections. A portion of an interior surface of the second triangular section is recessed to define a shoulder comprising an anti-rotation or anti-twisting feature. The wristband is secured in position between the post and the shoulder so as to inhibit the wristband from rotating or twisting along the shoulder of the clasp. The assembly includes one or more alignment surfaces that extend from the interior surface of the second triangular section. The one or more alignment recesses may be formed in an interior surface of the first triangular section that receives a portion of the second triangular section when the clasp is folded. At least one of the first and second triangular sections comprise an exterior recess formed in an exterior surface thereof for imprinting an alert message that identifies warnings and other relevant information about the person wearing the wristband. The assembly is made of fabric, plastic or resin material. The identification assembly for a person comprises a patient identification assembly for use with patients in a hospital or medical facility and comprises indicia that identify patients and provide information about those patients. The wristband is secured around the person's appendage such as a wrist or an ankle.

In one embodiment, an identification assembly for a person includes a wristband having at least one attachment aperture and at least one clasp having a folding base with first and second triangular sections connected together via a hinge that enables the base to be folded along a folding axis from an open position to a closed position so that the first and second triangular sections are adjacently positioned. The at least one clasp includes a securement aperture formed in the first triangular section and a post extending from the second triangular section that couples to the securement aperture when the base is folded along the folding axis in the closed position. The post extends from the second triangular section through the at least one attachment aperture of the wristband and couples to the securement aperture of the first triangular section so that the clasp is fastened to the wristband.

In one embodiment, a clasp device for use with a wristband having at least two attachment apertures includes a folding base having a first triangular section connected to a second triangular section and a hinge connecting the first and second triangular sections. The hinge defines a folding axis that enables the base to be folded so that the first triangular section is positioned adjacent to the second triangular section in an overlapping relationship. A securement aperture is formed in the first triangular section, and a post extends from the second triangular section to couple with the securement aperture of the first triangular section when the base is folded along the folding axis. The post extends from the second triangular section through the two attachment apertures of the wristband and couples to the securement aperture of the first triangular section so that the clasp is secured to the wristband.

In one embodiment, a clasp for a wristband having an attachment aperture includes a first triangular section having a securement aperture, a second triangular section having a post, and a hinge that attaches the first triangular section to the second triangular section. The hinge defines a folding axis that enables the clasp to be folded so that the first triangular section is positioned adjacent to the second triangular section. The post extends from the second triangular section through the attachment aperture of the wristband and couples to the securement aperture of the first triangular section so that the clasp is secured to the wristband. In one aspect, the clasp is foldable along the folding axis and folds from an open position to a closed position to secure the clasp to the wristband.

In one embodiment, an identification assembly includes a wristband and a plurality of triangular clasps secured to the wristband. One or more clasps extend from each side of the wristband, and the clasps are internested to take advantage of their triangular relationship and/or configuration. The clasps are coded to indicate information about a person.

In one aspect, the clasps are coded by color. The wristband includes a plurality of holes therein and at least one clasp extends through at least two holes thereby fixing the size of the wristband. Each clasp comprises two triangular sections including a hinge joining the two triangular sections and a post and aperture by which the clasp is secured to the wristband and held in a closed position. The clasps are coded by imprinting with words, symbols or color to indicate information about a person.

These and other objects and advantages of the present teachings will become more fully apparent from the following description taken in conjunction with the accompanying drawings.

DETAILED DESCRIPTION

Reference will now be made to the drawings wherein like numerals refer to like parts throughout.

Figure 1:
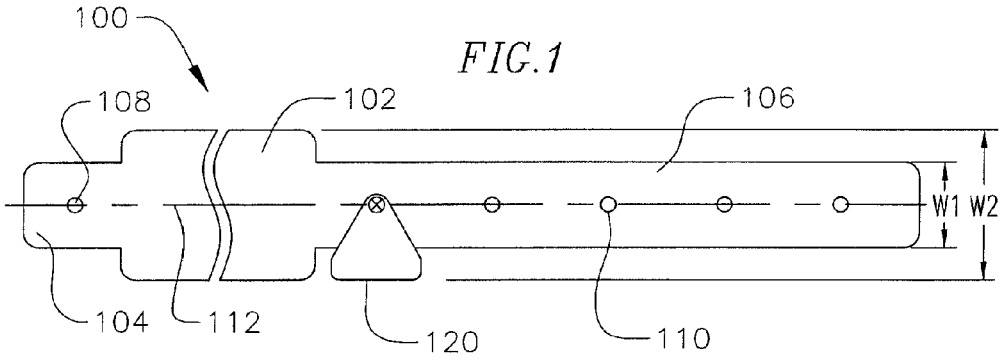
FIG. 1 shows one embodiment of an identification wristband and a clasp device.

An embodiment of a wristband 100, as shown in FIG. 1, has a display portion 102 for displaying identification information and fastening portions 104, 106 with one or more attachment apertures 108, 110 formed therein for securing a clasp, clip or snap device 120 thereto. In one aspect, the fastening portions 104, 106 have a width (w1) that is smaller than a width (w2) of the display portion 102, and the fastening portions 104, 106 extend along a central axis 112 of the display portion 102 of the wristband 100 so that the width (w1) of the fastening portions 104, 106 is centered within the width (w2) of the display portion 102 of the wristband 100.

As shown in FIG. 1, a first fastening portion 104 extends from one end of the display portion 102 and a second fastening portion 106 extends from the other end of the display portion 102. In one embodiment, the first fastening portion 104 of the wristband 100 has a single aperture 108 formed therein, and the second fastening portion 106 of the wristband 100 has a plurality of apertures 110 formed therein arranged along its center line. As shown in FIG. 1, a clasp 120 is securable to any one of the attachment apertures 108, 110 of the fastening portions 104, 106, and the clasp 120 comprises a triangular structure that folds over at least one of the fastening portions 104, 106 of the wristband 100. In general, the display portion 102 of the wristband 100 comprises a flat, rectangular section that is adapted to receive a label or direct print or hand written information, such as an adhesive label, having identification symbols, such as, for example, wording or verbiage, numeric symbols, alphanumeric symbols, barcode symbols and/or pictures.

Figure 2A:
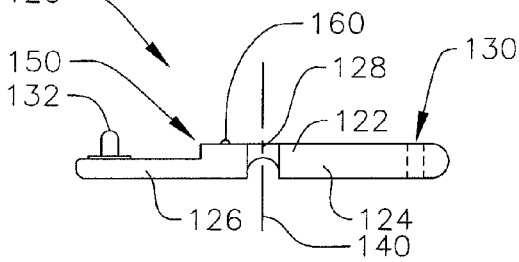
FIG. 2A is a side view of a clasp in an opened position

As shown in FIGS. 2A-3B, the clasp 120 comprises a folding base 122 having a first triangular plate-like member 124 connected to a second triangular plate-like member 126 via a hinge member 128. A securement aperture 130 is formed in the first triangular section 124, and a post or stem 132 extends from the second triangular section 126 and couples to the securement aperture 130 of the first triangular section 124 when the base 122 of the clasp 120 is folded along a folding axis 140. In one aspect, as shown in FIGS. 2A and 3A, the hinge 128 connects the first and second triangular sections 124, 126 and defines the folding axis 140 that enables the base 122 of the clasp 120 to be folded so that the first triangular section 124 is positioned adjacent to the second triangular section 126 in an overlapping relationship. In another aspect, the post 132 extends from the second triangular section 126 through at least one attachment aperture 108, 110 of the wristband 100 and couples to the securement aperture 130 of the first triangular section 124 so that the clasp 120 is secured to the wristband 100.

In one embodiment, the post 132 comprises a single post that extends from the second triangular section 126 to couple or interlock with the securement aperture 130, which comprises a single aperture formed in the first triangular section 124.

In one aspect, the hinge 128 is formed integrally with the first and second triangular sections 124, 126 to form the folding base 122 of the clasp 120, and the hinge 128 is foldable along the folding axis 140 so that the first and second triangular sections 124, 126 can be positioned adjacent and proximate to each other. The entire clasp can be molded as a single integral plastic piece.

A portion of an interior surface of the second triangular section 126 is recessed to define an abutment ridge or shoulder 150 serving as an anti-rotation or anti-twisting feature. In one aspect, the shoulder 150 forms a straight-edged ridge or shoulder that receives an edge of at least one fastening portion 104, 106 of the wristband 100, and the wristband 100 is secured in position between the post 132 and the shoulder 150 when the clasp 120 is folded so as to inhibit the wristband 100 from rotating, twisting or pivoting along or about the shoulder 150.

Figure 3A:
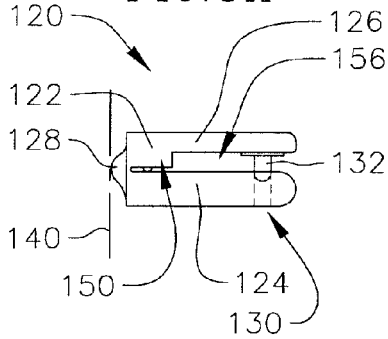
FIG. 3A is a side view of the clasp in a closed position.

As shown in FIG. 3A, when the clasp 120 assumes its closed position, a gap 156 adjacent to the shoulder 150 is formed between the first and second triangular sections 124, 126 so as to receive at least one fastening portion 104, 106 of the wristband 100. In general, when the clasp 120 is secured to at least one attachment aperture 108, 110 of the wristband 100, the at least one fastening portion 104, 106 of the wristband 100 is biased between the post 132 and the shoulder 150 of the clasp 120. In one aspect, because of the stabilizing effect of the shoulder 150, only one part is needed on each clasp.

The clasp 120 includes one or more alignment features 160 that protrude from the interior surface of the second triangular portion 126 adjacent to the hinge 128. The clasp 120 also includes one or more alignment recesses 162 formed in an interior surface of the first triangular section 124 that receives alignment features 160 of the second triangular section 126 when the clasp 120 is folded. In one embodiment, the clasp 120 comprises a fabric, plastic or resin material, and the clasp 120 comprises a solid color, such as, for example, red, purple, green, pink, yellow, orange and blue. It should be appreciated by those skilled in the art that the clasp 120 may have any shade of color or transparency of color without departing from the scope of the clasp 120. In addition, the clasp 120 may have one solid color or multiple colors. Each color can indicate a condition or procedure that applies to the individual patients.

The second triangular section 126 comprises an exterior recess 170 formed in an exterior surface thereof for, as an alternative to relying on color, permanently imprinting or scoring an alert message or verbiage that identifies warnings, such as, for example, an allergy, a do-not-resuscitate (DNR) directive and a fall risk. It should be appreciated by those skilled in the art that the exterior recess 170 may be formed in an exterior surface of the first triangular section 124 or both the first and second triangular sections 124, 126 without departing from the scope of the clasp 120. In addition, a removable or temporary label or sticker may be used for the alert message, symbol or verbiage. Moreover, identification information may be handwritten without departing from the scope of the present invention.

Figure 4A:
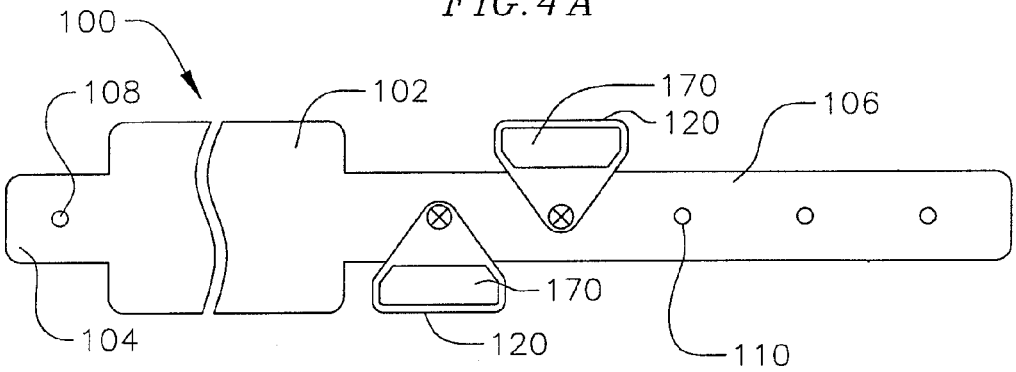
FIGS. 4A and 4B show various embodiments of a plurality of clasps mounted or secured to the wristband.
Figure 4B:
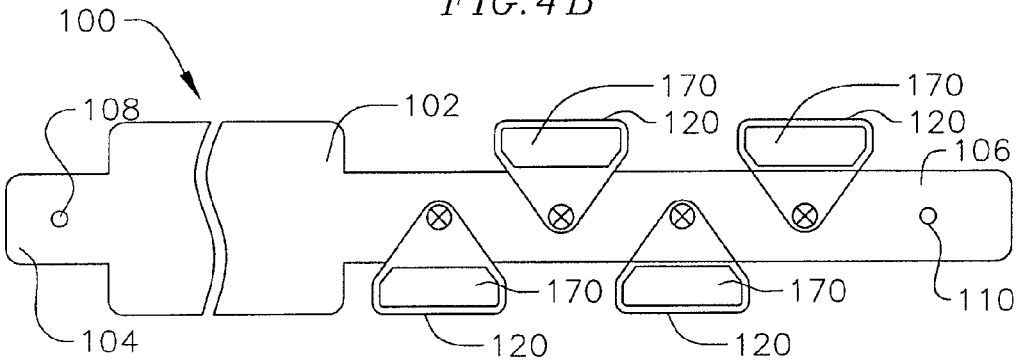

FIGS. 4A and 4B show various embodiments of a plurality of clasps 120 mounted or secured to the wristband 100. As shown in FIG. 1, a single clasp 120 can be secured to the wristband 100. As shown in FIG. 4A, two clasps can be secured to the wristband 100. As shown in FIG. 4B, four clasps can be secured to the wristband 100. It should be appreciated by those skilled in the art that any number of clasps 120 may be secured to the wristband 100 without departing from the scope of the assembly of one or more clasps 120 to the wristband 100. In one embodiment, FIGS. 1, 4A, and 4B show an assembly comprising the wristband 100 and the plurality of triangular clasps 120 secured to the wristband 100.

As shown in FIGS. 4A and 4B, a plurality of clasps 120 can be positioned on opposite sides of the wristband 100 and adjacent and proximate to each other in an alternating or interleaving manner. The triangular structure or shape of the clasps 120 and the single post securing feature enables for a smaller footprint for the triangular clasps 120 when secured to the wristband 100 along its length. The alternating or interleaving pattern of the triangular clasps 120 secured to the wristband 100 enables for more clasps 120 to be attached to the fastening portion 106 of the wristband 100. This allows a caregiver or patient care technician to safely indicate one or more alert messages. It should be appreciated that the clasps may communicate via color, words or other indicia any type of message the user would like to communicate on the wristband 100 for a particular person or patient depending on the person's or patient's individual needs. The clasp's smaller footprint is also more comfortable for the patient to wear.

Figure 5:
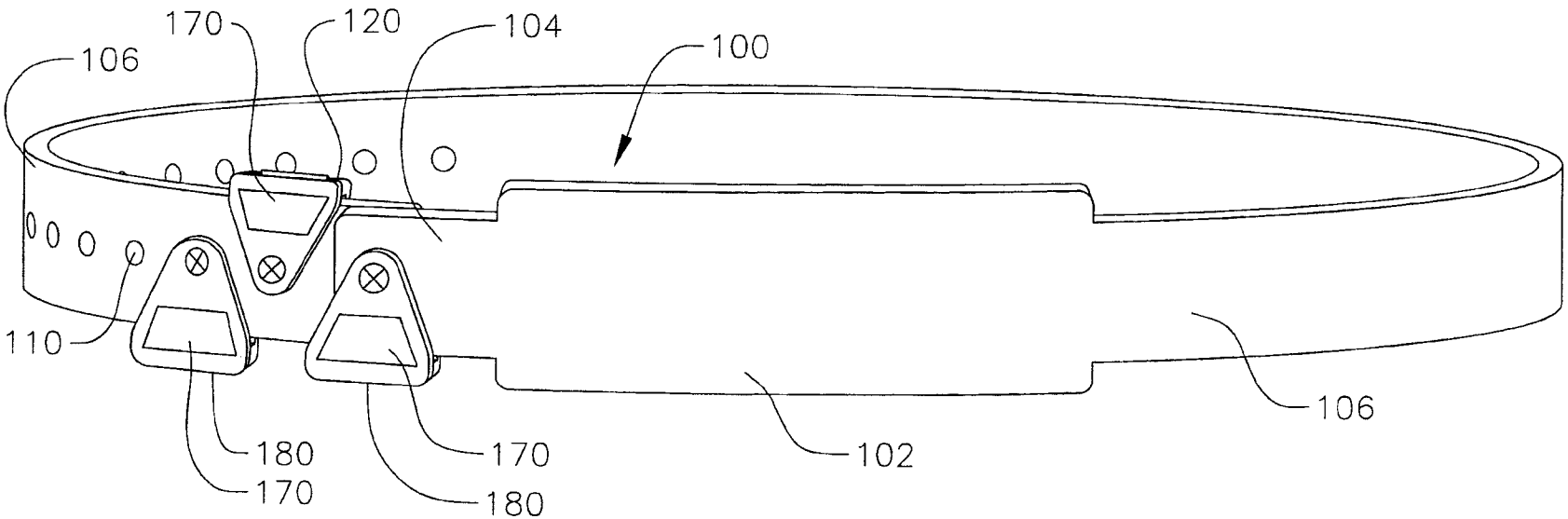
FIG. 5 is a perspective view of the wristband with fastening portions of the wristband secured together via the clasp.

As shown in FIG. 5, the wristband 100 has fastening portions 108, 110 of the wristband 100 secured together via the clasp 180, which is the same as clasps 120. In one embodiment, the wristband 100 and clasp 120 comprise an identification assembly for securing the wristband 100, as an identification wristband, to a client via the clasp 120. It should be appreciated that clasp 120 has multiple functions including securing the wristband 100 to a person or patient and also indicating information about the person or patient, wherein one of the clasps 120 may be used to secure the wristband 100 to the person or patient and one or more additional clasps 120, including the securing clasp 120, may be used for patient identification or treatment information for review by the caregiver.

Referring to FIGS. 2A and 5, the post 132 of the clasp 180 extends from the second triangular section 126 of the clasp 180 through the attachment apertures 108, 110 of the fastening portions 104, 106 of the wristband 100 and couples to the securement aperture 130 of the first triangular section 124 of the clasp 180 so that the clasp 180 secures the fastening portions 108, 110 of the wristband 100 together. As shown in FIG. 5, the fastening portions 104, 106 of the wristband 100 overlap in a manner such that the attachment apertures 108, 110 of the fastening portions 104, 106 are aligned whereby the post 132 of the clasp 180 can be extended through the two attachment apertures 108, 110 for securing the two fastening portions 104, 106 of the wristband 100 together. In general, the securing clasp 180 in this manner enables the wristband 100 to be secured around, for example, an appendage, such as an arm, wrist, leg or ankle of a client, such as a person or a patient, for identification purposes. In one aspect, the plurality of the clasps 120, 180 function as identifying elements of the wristband 100 to warn or alert a patient caregiver of alert messages or verbiage that identifies, for example, warnings, such as, for example, allergies, various types of directives, such as DNR, and fall risk. It should be appreciated by those skilled in the art that the aperture 108 of the fastening portion 104 can be attached or coupled to any one of the apertures 110 of the fastening portion 106 via the clasp 120, 180 without departing from the scope of the clasp 120, 180 or the wristband 100.

As shown in FIGS. 4A, 4B and 5, a plurality of clasps 120 can be fastened to the wristband 100, and each clasp can be positioned adjacent and proximate to each other in an alternating or interleaving relationship. The wristband 100 includes a plurality of attachment apertures 108, 110, and the plurality of clasps 120 can be fastened to the plurality of attachment apertures 108, 110 of the wristband in an alternating or interleaving relationship such that at least one clasp can be fastened to at least one attachment aperture 108, 110 from a first edge of the wristband 100 and at least one other clasp 120 can be fastened to at least one other attachment aperture 108, 110 from a second edge of the wristband 100 that is opposite of the first edge. In one aspect, the identification assembly for a person includes a patient identification assembly for use with patients in a hospital or medical facility and includes indicia or coding that identifies different treatments, warnings and/or alerts for patients. As shown in FIG. 5, the wristband 100 has holes or apertures 108, 110 formed therein, and at least one clasp 120 extends through at least two holes 108, 110 thereby fixing the size of the wristband 100.

Moreover, as shown in FIGS. 4A, 4B and 5, one or more clasps 120 may extend from each side or edge of the wristband 100, and the clasps 120 are interleaved or internested thereby taking advantage of their triangular configuration. In one aspect, the triangular clasps 120 fit together in an alternating manner. For example, as shown in FIGS. 4A, 4B and 5, two triangular clasps 120 extending from one side of the wristband 100 are positioned side-by-side in a manner to form a triangular gap or space where another triangular clasp 120 extending from the opposite side of the wristband 100 is received within the gap or space formed between the other two triangular clasps 120. This configuration allows a plurality of clasps 120 to be interleaved or internested along the length of the wristband 100 in an alternating manner. In one aspect, the clasps 120 can be coded to indicate information about a person or a patient, wherein each of the clasps 120 are coded, for example, by a color, symbol and/or verbiage or a plurality of different colors, symbols and/or verbiage.

Figure 2B:
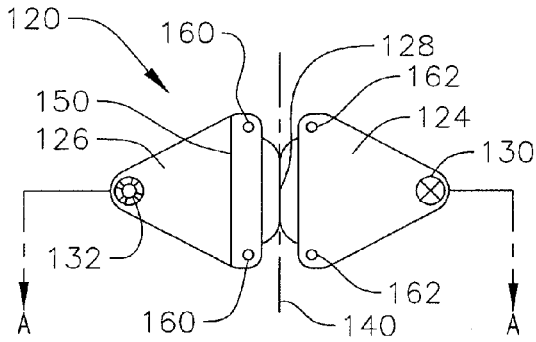
FIG. 2B is a top view of the clasp in the opened position.
Figure 3B:
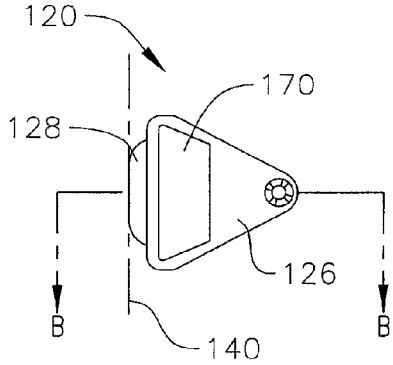
FIG. 3B is a top view of the clasp in the closed position.
Figure 6C:
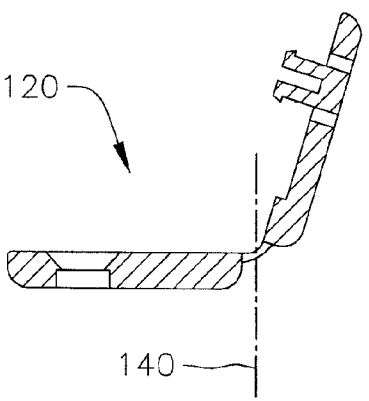
FIGS. 6A-6F are cross-sectional views of the clasp in various positions during folding of the clasp along a folding axis from the opened position to the closed position.
Figure 6B:
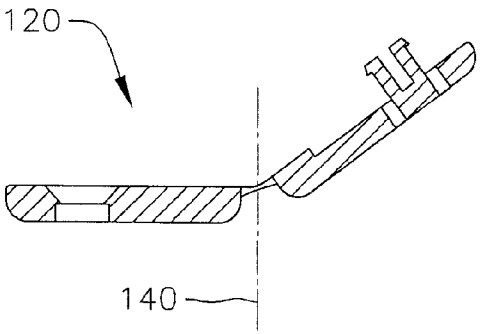
Figure 6A:
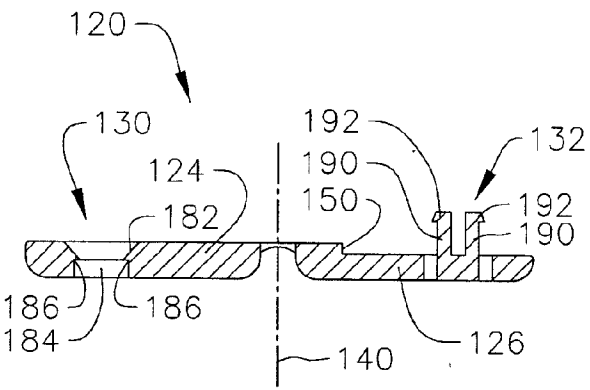
Figure 6F:
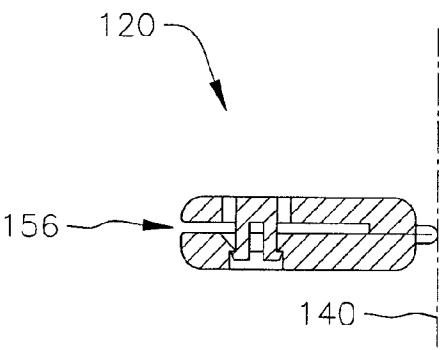
Figure 6E:
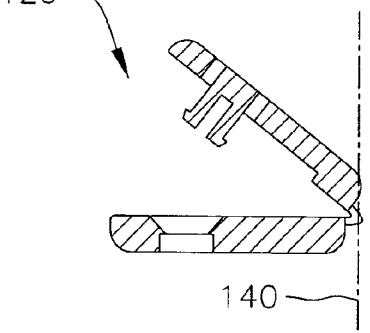
Figure 6D:
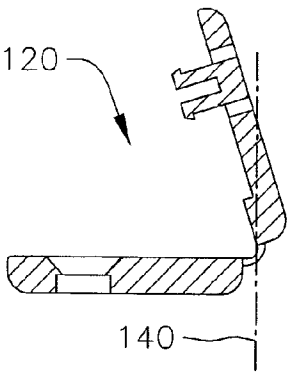

As shown in FIG. 6A, the clasp 120 is configured in an opened position taken along the lines A-A of FIG. 2B. As shown in FIG. 6F, the clasp 120 is configured in a closed position taken along the lines B-B of FIG. 3B. As shown in FIGS. 6B-6E, the clasp 120 is configured in various positions during folding of the clasp 120 along the folding axis 140 from the opened position of FIG. 6A to the closed position of FIG. 6F.

In one embodiment, as shown in FIG. 6A, the securement aperture 130 of the first triangular section 124 comprises a chamfered portion 182 and a coupling portion 184 having a tab region 186 that extends therefrom to receive the post 132 of the second triangular section 126. As shown in FIG. 6A, the post 132 of the second triangular section 126 comprises an elongate portion 190 having a clip region 192 that couples to the tab region 186 of the securement aperture 130. In one aspect, the securement aperture 130 and the post 132 are similarly circular or cylindrical in shape so as to communicate with each other for coupling to each other. In another aspect, the post 132 may comprise a slotted post with a plurality of sides or ribs along the length of the post 132.

In one embodiment, the elongated region 190 of the post 132 is flexible so that, during coupling of the post 132 to the securement aperture 130, the elongate region 190 of the post 132 moves or slides through the chamfered portion 182 and couples with the tab region 186 of the securement aperture 130 for securing the clip region 192 of the post 132 to the tab region 186 of the securement aperture 130, as shown in FIG. 6F. In one aspect, it should be appreciated by those skilled in the art that coupling or connecting the securing post 132 to the securement aperture 130 is permanent and tamper evident when removed, wherein the wristband 100 must be cut-off when removed from the patient, for example.

Figure 7A:
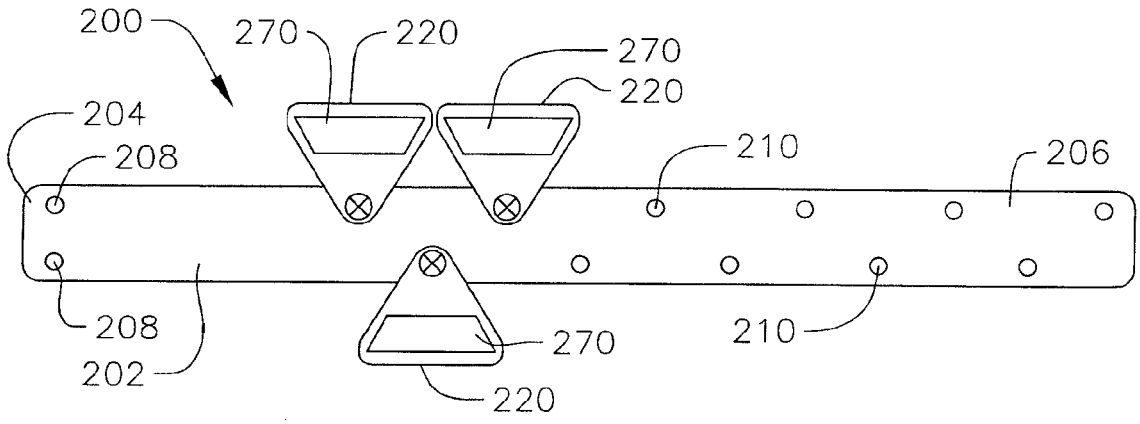
FIG. 7A shows another embodiment of a wristband.

As shown in FIG. 7A, another embodiment of a wristband 200 has a display portion 202 for displaying identification information and fastening portions 204, 206 with a plurality of attachment apertures 208, 210 formed therein for securing a clasp, clip or snap device 220 thereto. In one aspect, the fastening portions 204, 206 comprise the same width as the width of the display portion 202, and the fastening portions 204, 206 extend from the display portion 202 of the wristband 200.

As shown in FIG. 7A, a first fastening portion 204 extends from one end of the display portion 202 and a second fastening portion 206 extends from the other end of the display portion 202. In one embodiment, the first fastening portion 204 of the wristband 200 comprises at least two apertures 208 formed therein, and the second fastening portion 206 of the wristband 200 comprises a plurality of apertures 210, such as, for example, staggered apertures, formed therein. As shown in FIG. 7A, the clasp 220 is securable to any one of the apertures 208, 210 of the fastening portions 204, 206, and the clasp 220 comprises a triangular structure that folds over at least one of the fastening portions 204, 206 of the wristband 200. In general, the display portion 202 of the wristband 200 comprises a flat, elongated section that is adapted to receive a label, direct print or handwritten info, such as an adhesive label, having identification symbols, such as, for example, verbiage, wording, numeric symbols, alphanumeric symbols, graphic symbols and/or barcode symbols.

Figure 7B:
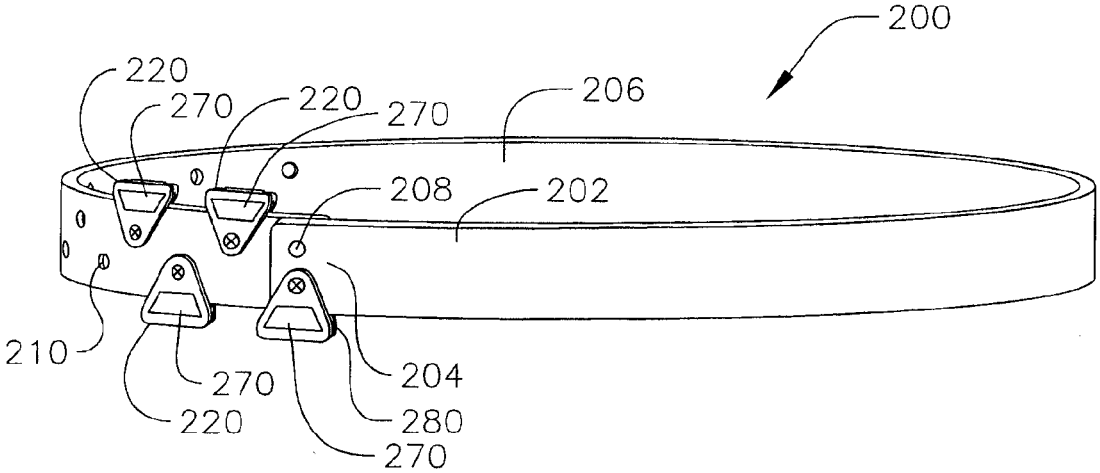
FIG. 7B is a perspective view of the wristband of FIG. 7A with fastening portions of the wristband secured together via the clasp.

FIG. 7B is a perspective view of the wristband 200 with the fastening portions 208, 210 of the wristband 200 secured together via the clasp 280, which is the same as clasps 220. The clasp 280 of FIG. 7B is similar to the clasp 180 of FIG. 5, and therefore, the scope and function of clasps 180, 280 are similar. In general, securing the clasp 280 enables the wristband 200 to be secured around, for example, an arm or wrist of a client, such as a person or patient, for identification purposes. Hence, in one embodiment, the wristband 200 and the clasp 220 comprise an identification assembly for securing the wristband 200, such as an identification wristband, to a client via the clasp 220.

In one aspect, the plurality of clasps 220, 280 function as identifying elements of the wristband 200 to warn or alert a patient caregiver of alert messages or verbiage that identifies warnings, such as, for example, allergies, various types of directives, such as DNR, and fall risks. It should be appreciated by those skilled in the art that the aperture 208 of the fastening portion 204 can be attached or coupled to any one of the apertures 210 of the fastening portion 206 via the clasp 220, 280 without departing from the scope of the clasp 220, 280 or the wristband 200.

It should be appreciated that wristbands 100, 200 of FIGS. 1 and 7A can be formed sequentially end-to-end and wound as a reel. This allows the reel of wristbands 100, 200 to be positioned in a printer and printed on one by one in a sequential manner and then detached from the reel one by one in a sequential manner for application to a client or patient. Wristbands may also be imaged on sheets and printed one by one and removed from the sheets when ready to place on the patient or client.

These and other embodiments of the present invention may be realized in accordance with the above teachings and it should be evident that various modifications and changes may be made to the above described embodiments without departing from the broader spirit and scope of the invention. The specification and drawings are, accordingly, to be regarded in an illustrative rather than restrictive sense and the invention measured only in terms of the claims.

The invention claimed is:

1. An identification assembly for a person, the assembly comprising: a wristband having at least one attachment aperture and a display portion for identification information; at least one clasp having a folding base with first and second shaped sections connected together via a hinge that enables the base to be folded along a folding axis from an open position to a closed position so that the first and second shaped sections are adjacently positioned, the at least one clasp having a securement aperture formed in the first shaped section and a post extending from the second shaped section that couples to the securement aperture when the base is folded along the folding axis in the closed position, wherein at least one of the first and second shaped sections is visually printed with information about the person and has a tapered shape such that it is capable of internesting with additional clasps secured to the wristband, wherein the post extends from the second shaped section through the at least one attachment aperture of the wristband and couples to the securement aperture of the first shaped section so that the clasp is fastened to the wristband and wherein the wristband comprises a plurality of attachment apertures, and wherein a plurality of clasps are fastened to the plurality of attachment apertures of the wristband in an alternating relationship such that at least one clasp is fastened to at least one attachment aperture from a first edge of the wristband and at least one other clasp is fastened to at least one other attachment aperture from a second edge of the wristband that is opposite of the first edge.

2. The assembly of claim 1 wherein the first and second shaped sections are triangular.

3. The assembly of claim 1, wherein a plurality of clasps are fastened to the wristband, and wherein each clasp is positioned adjacent and proximate to each other in an alternating relationship.

4. The assembly of claim 1, wherein the hinge of the clasp is formed integrally with the first and second shaped sections.

5. The assembly of claim 1, wherein a portion of an interior surface of the second shaped section is recessed to define a shoulder comprising an anti-rotation or anti-twisting feature.

6. The assembly of claim 5, wherein the wristband is secured in position between the post and the shoulder so as to inhibit the wristband from rotating or twisting along the shoulder of the clasp.

7. The assembly of claim 1, further comprising one or more alignment surfaces that extend from the interior surface of the second shaped section.

8. The assembly of claim 7, further comprising one or more alignment recesses formed in an interior surface of the first shaped section that receives a portion of the alignment surfaces when the clasp is folded.

9. The assembly of claim 1, wherein the first or second shaped section having the printed information comprises an exterior recess formed in an exterior surface thereof and wherein the printed information comprises a message that identifies warnings and other relevant information about the person wearing the wristband.

10. The assembly of claim 1, wherein the clasp is formed as a single integral plastic piece.

11. The assembly of claim 1, wherein the identification assembly for a person comprises a patient identification assembly for use with patients in a hospital or medical facility and comprises indicia that identify patients and provide information about those patients.

12. An identification assembly for a patient, the assembly comprising:

a band having a top surface, a bottom surface, a first end, and a second end opposite the first end, the second end being brought under the first end to form the band into an overlapping loop; and first and second clasp devices each comprising:

a top section for placement on the top surface of the band; and a bottom section for placement on the bottom surface of the band, wherein the top section is printed with one or more symbols to indicate information about the patient and has a tapered shape such that it is capable of internesting with additional clasps secured to the band, and wherein the top section engages the bottom section to attach the top section to the bottom section with the band extending between the top and bottom sections, wherein the first clasp is attached to the band with only one loop of the band extending between the top and bottom sections of the first clasp, and wherein the second clasp is attached to the band with two loops of the band extending between the top and bottom sections of the second clasp, to fix the size of the loop and wherein the first and second clasps are attached to the band in an alternating relationship such that the first clasp is attached to the band from a first edge of the band and the second clasp is attached to the band from a second edge of the band that is opposite the first edge.

13. The identification assembly of claim 12, wherein each clasp device, including the top section, the bottom section, and the one or more symbols, is integrally formed as one piece.

14. The identification assembly of claim 12, wherein the top section is triangular.

15. The identification assembly of claim 12, wherein the one or more symbols comprise a color.

16. The identification assembly of claim 12, wherein the one or more symbols comprise a letter.

17. The identification assembly of claim 12, wherein the one or more symbols comprise an image.

18. The identification assembly of claim 12, wherein the one or more symbols comprise a word.

19. The identification assembly of claim 12, wherein the one or more symbols comprise a plurality of colors.

20. The identification assembly of claim 12, wherein the one or more symbols comprise a color and at least one letter.

* * * * *